US011143153B2

(12) United States Patent
Mulye et al.

(10) Patent No.: US 11,143,153 B2
(45) Date of Patent: Oct. 12, 2021

(54) FLUID INJECTOR ORIFICE PLATE FOR COLLIDING FLUID JETS

(71) Applicant: NOSTRUM ENERGY PTE. LTD., Singapore (SG)

(72) Inventors: Nirmal Mulye, Kendall Park, NJ (US); Osanan L. Barros Neto, Commerce Township, MI (US); Frank S. Loscrudato, Ann Arbor, MI (US); William R. Atkinson, Houghton, MI (US)

(73) Assignee: NOSTRUM ENERGY PTE. LTD., Singapore (SG)

( * ) Notice: Subject to any disclaimer, the term of this patent is extended or adjusted under 35 U.S.C. 154(b) by 111 days.

(21) Appl. No.: 15/577,902

(22) PCT Filed: May 27, 2016

(86) PCT No.: PCT/US2016/034522

§ 371 (c)(1),
(2) Date: Nov. 29, 2017

(87) PCT Pub. No.: WO2016/196245

PCT Pub. Date: Dec. 8, 2016

(65) Prior Publication Data

US 2018/0171954 A1 Jun. 21, 2018

Related U.S. Application Data

(60) Provisional application No. 62/168,680, filed on May 29, 2015.

(51) Int. Cl.
*F02M 61/18* (2006.01)
*F02B 23/06* (2006.01)

(52) U.S. Cl.
CPC .... *F02M 61/1813* (2013.01); *F02M 61/1846* (2013.01); *F02M 61/1853* (2013.01); *F02B 23/0669* (2013.01)

(58) Field of Classification Search
CPC ..... F02M 61/1806; F02M 61/1813; F02M 61/182–1846; F02M 61/1853
(Continued)

(56) References Cited

U.S. PATENT DOCUMENTS 5,540,200 A * 7/1996 Naitoh ..... F02M 51/065 123/299
5,931,391 A * 8/1999 Tani ..... F02M 51/0671 239/522

(Continued)

FOREIGN PATENT DOCUMENTS

CN 103270369 A 8/2013
JP 08035463 A 2/1996

(Continued)

OTHER PUBLICATIONS

Extended European Search Report dated Feb. 11, 2019 issued in corresponding European Patent Application No. 16804091.3.

(Continued)

*Primary Examiner* — Cody J Lieuwen
(74) *Attorney, Agent, or Firm* — Jonathan D. Ball; Tanzina Chowdhury

(57) ABSTRACT

An injector nozzle used with an internal combustion engine for shaping a fluid flow is provided. The nozzle has a body and an orifice plate provided at an outlet of the body. The body and the plate extend symmetrically with respect to a central axis. The plate has an interior surface and an opposite exterior surface, which are substantially parallel to each other to define a thickness of the plate. The plate has fluid passageways each having an orifice on the exterior surface.

(Continued)

The fluid flow diverges through the fluid passageways to create stream jets. The imaginary extensions the passageways converge to create a focal point and an included angle associated with the focal point.

19 Claims, 12 Drawing Sheets

(58) Field of Classification Search
USPC ..... 239/533.12, 533.2, 585.1, 596
See application file for complete search history.

(56) References Cited

U.S. PATENT DOCUMENTS

| | | | | |
|---|---|---|---|---|
| 6,089,476 | A * | 7/2000 | Sugimoto | F02M 61/1806 239/533.12 |
| 9,709,010 | B2 * | 7/2017 | Kato | F02M 51/06 |
| 9,850,870 | B2 | 12/2017 | Mulye | |
| 2001/0042800 | A1 * | 11/2001 | Sato | F02M 61/1813 239/585.1 |
| 2003/0015609 | A1 * | 1/2003 | Kobayashi | B05B 1/14 239/584 |
| 2003/0222159 | A1 | 12/2003 | Kobayashi et al. | |
| 2006/0157595 | A1 * | 7/2006 | Peterson, Jr. | F02M 61/1846 239/533.12 |
| 2006/0202062 | A1 | 9/2006 | Mohamed et al. | |
| 2008/0169367 | A1 * | 7/2008 | Oomura | F02M 61/1813 239/584 |
| 2013/0104847 | A1 | 5/2013 | Ishii et al. | |
| 2013/0327045 | A1 | 12/2013 | Fox et al. | |
| 2014/0252137 | A1 * | 9/2014 | Oomura | F02M 61/1806 239/558 |
| 2017/0335814 | A1 * | 11/2017 | Yoshimura | F02M 61/1806 |
| 2018/0283339 | A1 | 10/2018 | Mulye | |

FOREIGN PATENT DOCUMENTS

| | | | |
|---|---|---|---|
| JP | 08303321 | A | 11/1996 |
| JP | 1050214 | A | 2/1998 |
| JP | 11082243 | A | 3/1999 |
| JP | 2003-328903 | A | 11/2003 |
| WO | 9600847 | A1 | 1/1996 |
| WO | 2015057801 | A1 | 4/2015 |

OTHER PUBLICATIONS

International Search Report dated Aug. 31, 2016 issued in PCT/US2016/034522.
Taiwan Office Action dated Aug. 20, 2019 from Taiwan Patent Application No. 105116880.

* cited by examiner

FLUID INJECTOR ORIFICE PLATE FOR COLLIDING FLUID JETS

CROSS-REFERENCE TO RELATED APPLICATIONS

This application claims the benefit of U.S. Provisional Application No. 62/168,680 filed on May 29, 2015, and is a '371 of International Application PCT/US2016/034522, filed on May 27, 2016, the entire contents of both of which are incorporated herein by reference.

FIELD OF THE DISCLOSURE

The present disclosure relates to an apparatus and method for creating an atomized liquid that can be volatile or non-volatile. More particularly, the present disclosure relates to a fluid injector used for internal combustion engines, which injector has an orifice plate configured to implement effective collisions of a plurality of fluid jets.

BACKGROUND

Improving the atomization of liquids for use in internal combustion engines and powertrain systems is an important aspect of the design and operation of spark ignition or compression ignition engines. A key aspect is the liquid utilization, or the volume of a volatile and/or a non-volatile liquid, such as fuels and/or water, respectively, participating in the intended purpose (such as combustion). The atomization of fuels is of particular importance to internal combustion engines including spark ignition engines or compression ignition engines.

Conventional methodology relies on the use of very high fluid pressures, very small orifices, jet collisions with acute or small included angles, resonance phenomena, partial impinging sprays, and impinging air and fuel sprays.

Achieving effective atomization of liquids, whether for cooling, knock reduction, NOx reduction, or improved combustion efficiency, is an important aspect of the design and operation and provides significant advantages to the internal combustion engine.

Both liquid fuels and water are typically injected into engines. Fuels can be diesel-type fuels, gasoline (petrol), alcohols, and mixtures thereof. Alcohols include ethanol and methanol, which are commonly blended with gasoline. Water is also often injected into engines to provide an internal cooling effect and knock or NOx reduction.

Modern engines typically use fuel injection to introduce fuel into the engine. Such fuel injection may be by port injection or direct injection. In port injection, fuel injectors are located at some point in the intake tract or intake manifold before the cylinder. In direct injection, an injector is in each cylinder.

Atomization of fuels and other liquids injected into engines has been used in combustion. Optimally, any injected liquid is atomized prior to contact of a stream of injected liquid with any interior surface of the engine. If liquid contacts surfaces, it can wash away lubricants, and pool, resulting in sub-optimal combustion. Pooled fuel during combustion causes carbon deposits, increased emissions, and reduced engine power. Alternatively, when water is injected, the impingement on the non-lubricated internal surfaces, such as cylinder head and piston face, can provide some benefits.

The spray configuration in conventional fuel injectors or atomizers typically consists of one or more jets or streams aimed outwards from the injector, but this configuration is limited and under certain circumstances may result in impingement of liquids on the intake manifold and intake port walls, causing a film to form which needs to be accounted for in transient fueling calculations.

An approach to effective atomization is the use of high pressure liquid injection and small orifices, but this comes at the cost of higher parasitic losses due to the high power required to drive high pressure pumps. Additionally, high pressure systems tend to be more expensive and less reliable, and small orifices are prone to clogging.

Also an approach to effective atomization is to use air shear with the liquid, where high pressure fast moving air is used to shear liquid stream to achieve atomization. This approach has its own limitations in terms of breaking the liquid droplets, the high air demand and the high parasitic drag associated with producing sufficient quantities of compressed air.

Therefore, there is a need for improved fluid injector that is cost efficient to manufacture.

SUMMARY

According to an exemplary aspect of the present disclosure, an injector nozzle used with an internal combustion engine for guiding and shaping a fluid flow is provided. The injector nozzle includes a nozzle body that has an inlet for admitting the fluid flow and an outlet. The injector nozzle also includes an orifice plate provided at the outlet of the nozzle body. The nozzle body and the orifice plate are both configured to extend symmetrically with respect to a central axis. The orifice plate has an interior surface facing the nozzle body and an opposite exterior surface. The interior surface and the exterior surface are substantially planar and parallel to each other and together define a thickness of the orifice plate. A cavity is defined between the orifice plate and the nozzle body. The fluid flow converges at the cavity. The orifice plate includes a plurality of fluid passageways, each fluid passageway having an orifice on the exterior surface. The fluid passageways extend from the interior surface to the exterior surface and are in fluid communication with the cavity. The fluid flow diverges through the fluid passageways to create a plurality of stream jets. The imaginary extensions of the plurality of passageways converge to create at least one focal point and at least one included angle associated with the focal point.

DETAILED DESCRIPTION OF EXEMPLARY EMBODIMENTS

Figure 1:
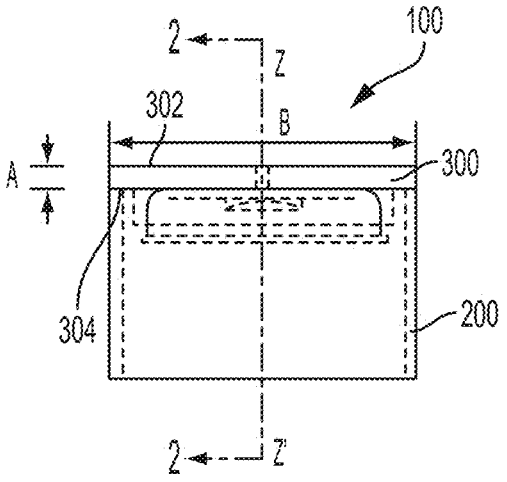
FIG. 1 is a side view of an injector nozzle, according to an exemplary embodiment of the disclosure.

Detailed embodiments of the present disclosure are described herein; however, it is to be understood that the disclosed embodiments are merely illustrative of the compositions, structures and methods of the disclosure that may be embodied in various forms. In addition, each of the examples given in connection with the various embodiments is intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the compositions, structures and methods disclosed herein. References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. When referring to diameters, distances and angles hereinbelow, statements that diameters may be about the same or that distances may be about the same or that the values of angles may be about the same or any other expression used which may be synonymous thereto, refers to the values of each are about the same, but the individual values may be the same or different. For example, the statement, such as the passageways have about the same uniform diameter, refers to the passageways having about the same diameter, but the actual diameters of each of the passageways may be the same as or different from one another. If reference is made to more than two passageways, the actual diameters of each of the passageways may be the same or different relative to each other. For example, if there are four passageways, two may have the same diameter and two may have different diameters, or all three passageways may have the same diameter or all four may have the same diameter or the diameters of each of the passageways are different. The same is also applicable when referring to the distances between focal points or angles. For instance, if the text refers to the values of two or more angles being substantially the same, it is to be understood that each of the values may be the same, but the actual values of each of the angles may be the same or different from one another.

As used herein, the term "focal point" refers to a geometric convergence point. These terms are thus synonymous and are used interchangeably herein.

One aspect of the disclosure provides an injector or nozzle for injecting liquids into reciprocating or rotary internal combustion engines. Such liquids include, but are not limited to, fuels, water or aqueous solutions. When the injector is in use, two or more liquid jets are aimed at an impingement point under pressure. The collision of the jets at the impingement point efficiently atomizes the liquid.

Compressed liquids, such as water or liquid fuels, possess a specific potential energy, or SPE, where $SPE=\Delta P/\rho$, where $\Delta P$ the pressure drop across a fuel nozzle in $kN/m^2$, and $\rho$ is liquid density in $kg/m^3$. Accordingly, $SPE=\Delta P/\rho=kJ/kg$. Thus, for water at 10 bar pressure difference and a density of 1000, SPE=1 kJ/kg. When expanded ideally, this will result into a jet velocity of $v=(2\Delta P/\rho)^{1/2}=(200)^{1/2}=100$ m/s. When two or more such jets collide, small regions of high pressure stagnation recovery (at 50% recovery about 5 bar) are created, and a small portion of the energy will cause a small fraction of the liquid in the jet to vaporize, creating a very powerful additional mechanism of disintegration, besides shear and turbulence disintegration mechanisms. As compared to water, which has the largest latent heat, other liquid fuels, such as gasoline or alcohols, will exhibit a significantly improved atomization at significantly less pressures and higher orifice diameters.

The theoretical velocity/speed of the liquid jet coming out of the nozzle is greater than 10 m/s. For example, the theoretical velocity/speed of the liquid jet can be 20 m/s, 25 m/s, 30 m/s, 50 m/s, 75 m/s or 100 m/s or higher.

The injector or nozzle, according to an aspect of the disclosure, provides atomization superior to known methods in fuel or water injection for engines. For example, the inward angle of the jets provided by the liquid passage configuration in the nozzle is a substantial improvement over conventional techniques providing efficient atomization in proximity to the injector body, and preventing streams of liquids from impacting interior solid surfaces in the engine.

FIG. 1 is a side view of an injector nozzle 100, according to an exemplary embodiment of the present disclosure. The injector nozzle 100 is provided at a liquid outlet of an injector (the entire injector is not shown). The injector also has a liquid inlet, through which a pressurized liquid is fed into the injector. The injector nozzle 100 is designed to control the direction or characteristics of a fluid flow (for example, to increase velocity of the fluid flow), as the fluid flow exits the injector. The injector nozzle 100 includes a substantially cylindrical nozzle body 200 and a disk-like orifice plate 300, both extending substantially symmetrically with respect to a central axis Z-Z'. The nozzle body 200 and the orifice plate 300 can be formed integrally, assembled together or retrofittably fixed together.

The orifice plate 300 has an exterior surface 302 and an opposite interior surface 304. The exterior surface 302 is downstream with respect to the interior surface 304, in view of the flowing direction of a liquid jet. The exterior surface 302 and the interior surface 304 are substantially planar and parallel to each other, thereby defining a uniform thickness A of the orifice plate 300. For example, the uniform thickness A of the orifice plate 300 can range from about 0.25 mm to about 4.0 mm; the thickness A can be 0.25 mm, 0.3 mm, 0.35 mm, 0.4 mm, 0.45 mm, 0.5 mm, 0.55 mm, 0.6 mm, 0.65 mm, 0.7 mm, 0.75 mm, 0.8 mm, 0.85 mm, 0.9 mm, 0.95 mm, 1.0 mm, 1.1 mm, 1.2 mm, 1.3 mm, 1.4 mm, 1.5 mm, 1.6 mm, 1.7 mm, 1.8 mm, 1.9 mm, 2.0 mm, 2.1 mm, 2.2 mm, 2.3 mm, 2.4 mm, 2.5 mm, 3.0 mm or 4.0 mm. The orifice plate 300 has a diameter B, which can range from about 4.0 mm to about 14.0 mm; the diameter can be 4.0 mm, 4.1 mm, 4.2 mm, 4.3 mm, 4.4 mm, 4.5 mm, 4.6 mm, 4.7 mm, 4.8 mm, 4.9 mm, 5.0 mm, 5.1 mm, 5.2 mm, 5.3 mm, 5.4 mm, 5.45 mm, 5.5 mm, 5.6 mm, 5.7 mm, 5.8 mm, 5.9 mm, 6.0 mm, 6.1 mm, 6.2 mm, 6.3 mm, 6.4 mm, 6.5 mm, 6.6 mm, 6.7 mm, 6.8 mm, 6.9 mm, 7.0 mm, 7.1 mm, 7.2 mm, 7.3 mm, 7.4 mm, 7.5 mm, 7.6 mm, 7.7 mm, 7.8 mm, 7.9 mm, 8.0 mm, 8.1 mm, 8.2 mm, 8.3 mm, 8.4 mm, 8.5 mm, 8.6 mm, 8.7 mm, 8.8 mm, 8.9 mm, 9.0 mm, 9.1 mm, 9.2 mm, 9.3 mm, 9.4 mm, 9.5 mm, 9.6 mm, 9.7 mm, 9.8 mm, 9.9 mm, 10.0 mm, 10.1 mm, 10.2 mm, 10.3 mm, 10.4 mm, 10.5 mm, 10.6 mm, 10.7 mm, 10.8 mm, 10.9 mm, 11.0 mm, 11.1 mm, 11.2 mm, 11.3 mm, 11.4 mm, 11.5 mm, 11.6 mm, 11.7 mm, 11.8 mm, 11.9 mm, 12.0 mm, 12.1 mm, 12.2 mm, 12.25 mm, 12.3 mm, 12.4 mm, 12.5 mm, 12.6 mm, 12.7 mm, 12.8 mm, 12.9 mm, 13.0 mm, or 14.0 mm.

Figure 2:
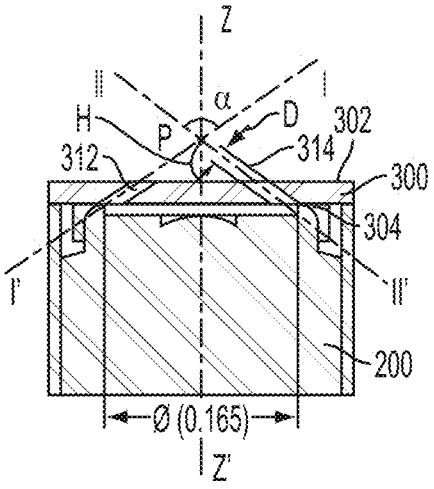
FIG. 2 is a cross section view of the injector nozzle along lines 2-2.

FIG. 2 is a cross section view of the injector nozzle 100 along lines 2-2. In the shown embodiment, the orifice plate 300 has a first fluid passageway 312 and a second fluid passageway 314, both of which extend inwardly angularly with respect to the central axis Z-Z' from the interior surface 304 to the exterior surface 302.

In the shown embodiment, the first fluid passageway 312 forms a part of an imaginary cylinder extending along axis I-I' and the second fluid passageway 314 forms a part of an imaginary cylinder extending along axis II-II'. Both the first fluid passageway 312 and the second fluid passageway 314 are radially consistent along its respective axis and each independently has a constant diameter D. Alternatively, the fluid passageways may have a tapered diameter with an average diameter D, which taper may be up to 20% of D. For example, the diameter D can be in a range from about 80 um to about 1000 um. For example, the diameter D of each passageway can be 80 um, 90 um, 100 um, 110 um, 120 um, 130 um, 140 um, 150 um, 160 um, 170 um, 180 um, 190 um, 200 um, 210 um, 220 um, 230 um, 240 um, 250 um, 260 um, 270 um, 280 um, 290 um, 300 um, 310 um, 320 um, 330 um, 340 um, 350 um, 360 um, 370 um, 380 um, 390 um, 400 um, 500 um, 600 um, 700 um, 800 um, 900 um or 1000 um. In one embodiment, the diameter D of passageway 312 and the diameter D of passageway 314 are substantially the same.

As shown in FIG. 2, the first fluid passageway 312 and the second fluid passageway 314 are configured, such that the axis I-I' of the first fluid passageway 312 and the axis II-II' of the second fluid passageway 314 intersect each other at a converging point P on the axis Z-Z', thereby forming an included angle $\alpha$. For example, the included angle $\alpha$ is greater than about 50°; in another example, the included angle is in a range from about 50° to about 89°; in still another example, the included angle is greater than about 90°; in still another embodiment, the included angle is in a range from about 91° to about 99°; in yet another embodiment, the included angle $\alpha$ can range from about 100° to about 160°; in still yet embodiment, the included angle $\alpha$ can range from about 110° to about 150°; in still another embodiment, the included angle $\alpha$ can range from about 120° to about 140°; in a further embodiment, the included angle $\alpha$ can be about 120°. The distance H from the converging point P to the exterior surface 302 of the orifice plate 300, along the axis Z-Z', can range from about 0.25 mm to about 28.0 mm, while in another embodiment, it can range from 0.25 mm to about 24 mm, and in still another embodiment, it can range from about 0.25 mm to about 20 nm, while in another embodiment, it can range from about 0.25 to about 4 mm. For example, the distance H can be 0.25 mm, 0.5 mm, 0.6 mm, 0.7 mm, 0.8 mm, 0.9 mm, 1.0 mm, 1.5 mm, 2.0 mm, 2.5 mm, 3.0 mm, 3.5 mm, 4.0 mm, 4.5 mm, 5.0 mm, 5.5 mm, 6.0 mm, 7.0 mm, 8.0 mm, 9.0 mm, 10.0 mm, 11.0 mm, 12.0 mm, 13.0 mm, 14.0 mm, 15.0 mm, 16.0 mm, 17.0 mm, 18.0 mm, 19.0 mm, 20.0 mm, 21.0 mm, 22.0 mm, 23.0 mm, 24.0 mm, 25.0 mm, 26.0 mm, 27.0 mm or 28.0 mm or any number therebetween.

Figure 3:
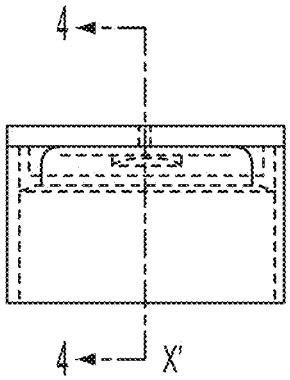
FIGS. 3 and 4 illustrate the injector nozzle, when it is used with a ball pintle to allow metered fluid flow.
Figure 4:
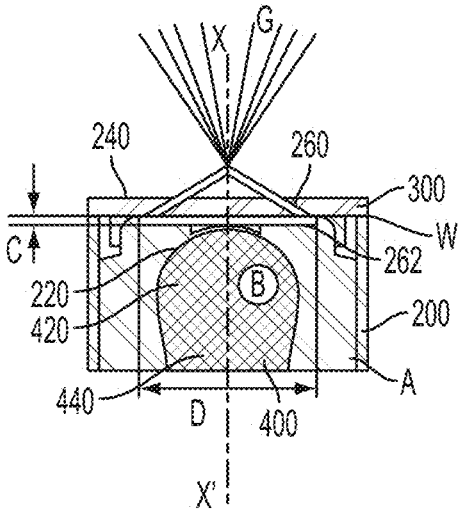

FIGS. 3 and 4 illustrate the injector nozzle 100, when the injector nozzle is used with a ball pintle 400 to allow metered fluid flow. The pintle 400 can be a solenoid controlled pintle or a piezoelectrically actuated pintle, and it can be directly actuated or pilot actuated via a pressure differential across the housing. The pintle 400 includes a pintle ball 420 and a pintle shaft 440. When at a default position, the pintle ball 420 is pressed against a valve seat 220 of the nozzle body 200. When the pintle ball 420 is pressed against the valve seat 220, no liquid can flow into an opening 240 at the valve seat 220 and no liquid flows out of the injector nozzle 100. When the pintle ball 420 is shifted to the open position, pressurized liquid flows through the opening 240 into a cavity 260 defined between the nozzle body 200 and the orifice plate 300. Subsequently, the pressurized liquid flows from the cavity 260 into the fluid passageways 312 and 314, respectively. Alternatively, a needle or a plate can be employed in lieu of a ball pintle, as the valve mechanism.

The cavity 260 is defined by the interior surface 304 of the orifice plate 300 and an internal surface 262 of the nozzle body 200. The internal surface 262 and the interior surface 304 are substantially parallel with each other to define a height or depth C of the cavity 260. The cavity 262 is a substantially cylindrical space and has a diameter D that is smaller than the diameter B of the orifice plate 300. For example, the diameter D of the cavity can be up to 0.5 mm. The height C can vary ranging from about 5 um to about 500 um. For example, the height C can be less than 100 um; the height C can range from about 5 to about 9.9 um; from about 10 to about 14.9 um; from about 15 to about 19.9 um; from about 20 to about 24.9 um; from about 25 to about 29.9 um; from about 30 to about 34.9 um; from about 35 to about 39.9 um; from about 40 to about 49.9 um; from about 50 to about 59.9 um; from about 60 to about 69.9 um; from about 70 to about 79.9 um; from about 80 to about 89.9 um; from about 90 to about 99.9 um; from about 100 to about 149.9 um; from about 150 to about 200 um; from about 200 to about 250 um; from about 250 to about 300 um; from about 300 to about 350 um; from about 350 to about 400 um; from about 400 to about 450 um; or from about 450 to about 500 um.

The cavity 262 functions to diverge the pressurized fluid flow outwardly from the nozzle body 200 into the entrance of the fluid passageways 312 and 314, thereby creating two fluid stream jets that pass through the fluid passageways 312 and 314, respectively. The stream jets, as guided and shaped by the fluid passageways 312 and 314, respectively, converge and impinge on each other at a focal point F (also known as geometric convergence point), which in turn creates a spray plume G of atomized fluid. Optimally, the focal point F created by the two impinging stream jets and the converging point P created by the geometry of the two fluid passageways 312 and 314 coincide each other. As a result, the distance from the focal point F to the exterior surface 302 of the orifice plate 300, along the axis Z-Z', can be the same as the distance from the converging point P to the exterior surface 302. For example, the pressure applied to the liquid can range from about 5 psi to about 500 psi; the pressure can be 5 psi, 10 psi, 15 psi, 20 psi, 25 psi, 30 psi, 40 psi, 50 psi, 60 psi, 70 psi, 80 psi, 90 psi, 100 psi, 150 psi, 200 psi, 250 psi, 300 psi, 350 psi, 400 psi, 450 psi or 500 psi. In some embodiments, the pressure applied to the liquid can be greater than 500 psi, e.g., 3000 psi or 5000 psi.

Figure 5A:
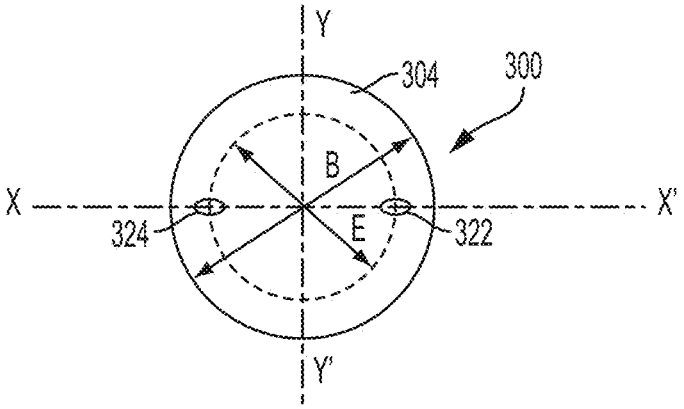
FIG. 5 schematically illustrates the detailed structure of an orifice plate of the injector nozzle.
Figure 5B:
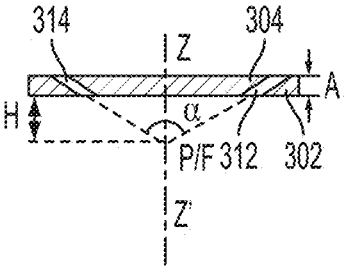

FIG. 5 schematically illustrates the detailed structure of the orifice plate 300. FIG. 5(*a*) is an end view of the orifice plate 300, when the orifice plate 300 is viewed from the interior surface 302 that is in a plane defined by the axis X-X' and the axis Y-Y'. The first fluid passageway 312 has a first orifice 322 on the interior surface 304 and the second fluid passageway 314 has a second orifice 324 on the interior surface 304. The first orifice 322 and the second orifice 324 are opposite each other and radially distributed along an imaginary circle having a diameter E, which is smaller than the diameter B of the orifice plate 300. The first orifice 322 and the second orifice 324 are symmetrically distributed radially with respect to the central axis Z-Z', along the imaginary circle. The first orifice 322 and the second orifice 324 are angularly distanced from each other by about 180°.

FIG. 5(*b*) is a schematic sectional view of the orifice plate 300, consistent with FIG. 5(*a*). The distance H from the focal point F (or the converging point P) to the exterior surface 302 is affected by both the distance E between the first orifice 322 and the second orifice 324 and the thickness A of the orifice plate. According to this embodiment, both the distance E and the thickness A are configured to ensure that the distance H is ranges from about of 0.25 mm to about 28.0 mm. Although not shown in this embodiment, within the scope of the disclosure, three or more fluid passageways (and their associated orifices) can be formed to provide a single focal point on the axis Z-Z'. The three or more orifices can be equiangularly distributed on the imaginary circle.

Figure 6A:
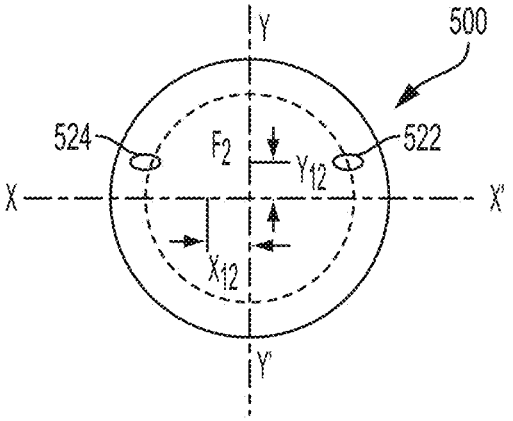
FIG. 6 illustrates an orifice plate according to another embodiment of the disclosure.
Figure 6B:
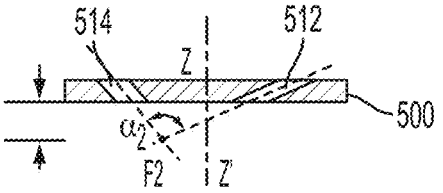
Figure 7A:
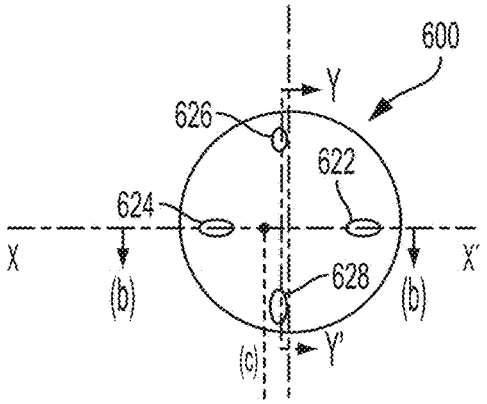
FIG. 7 illustrates an orifice plate according to still another embodiment of the disclosure.
Figure 7B:
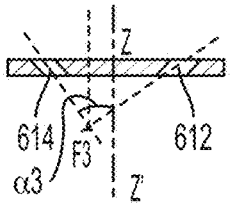
Figure 7C:
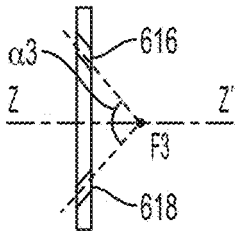
Figure 7D:
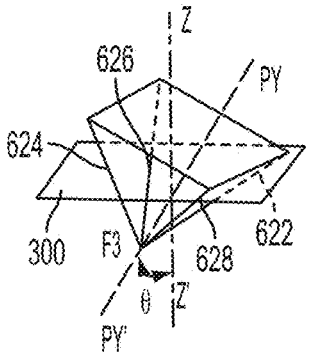

FIG. 6 illustrates an orifice plate 500 according to another embodiment of the disclosure. The orifice plate 500 has same or similar structures as the orifice plate 300, except for the structures of the fluid passageways and the orifices. The orifice plate 500 has a first fluid passageway 512 and a second fluid passageway 514, which have substantially the same uniform diameter. The first fluid passageway 512 has a first orifice 522 and the second fluid passageway 514 has a second orifice 524. The first fluid passageway 512 and the second fluid passageway 514 form an included angle α2 and a focal point F2. The focal point F2 is not aligned centrally to the center of the orifice plate 500 in the XY plane. The focal point F2 is offset a distance (X12 and Y12) from the center of the orifice plate 500. The distance from the focal point F2 to the exterior surface of the orifice plate 500 can be substantially the same as the distance H of the orifice plate 300. The value of the included angle α2 can be substantially the same as that of the included angle α of the orifice plate 300. According to this embodiment, the single focal point is offset in both the X-X' axis and Y-Y' axis from the central axis Z-Z'.

FIG. 7 illustrates an orifice plate 600 according to still another embodiment of the disclosure. The orifice plate 600 has same or similar structures as the orifice plate 300, except for the structures of the fluid passageways and the orifices. The orifice plate 600 includes a first fluid passageway 612 having a first orifice 622, a second fluid passageway 614 having a second orifice 624, a third fluid passageway 616 having a third orifice 626, and a fourth fluid passageway 618 having a fourth orifice 628. All of the fluid passageways have substantially the same uniform diameter. The four fluid passageways form a single focal point F3 and an included angle α3. The distance from the focal point F3 to the exterior surface of the orifice plate 600 can be substantially the same as the distance H of the orifice plate 300. The included angle α3 can be substantially the same as the included angle α of the orifice plate 300. According to this embodiment, the single focal point F3 is offset in the X-X' axis from the central axis Z-Z'. In this embodiment, the focal point F3 can be considered an apex of an imaginary pyramid that has four triangular sides and a square base, as shown in FIG. 7(*d*). The axis PY-PY' of the pyramid, which passes the apex and extends vertically to the square base of the pyramid, is rotatably shifted to form an angle θ with the central axis Z-Z' of the orifice plate 300. As a result, the geometry of the pyramid is globally shifted with respect to the co-ordinate system of the orifice plate 300. In this case, the four fluid passage ways and their associated orifices can be considered as generated by the intersection of the four edges of the globally shifted imaginary pyramid with the orifice plate.

Figure 8A:
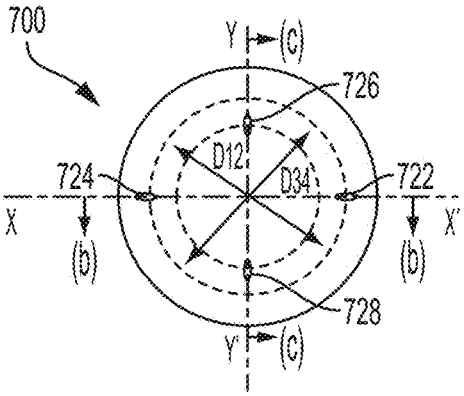
FIG. 8 illustrates an orifice plate according to still another embodiment of the disclosure.
Figure 8B:
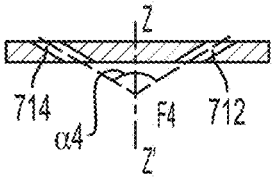
Figure 8C:
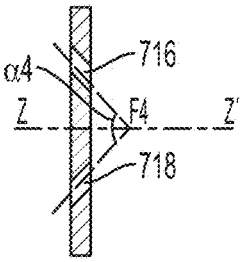

FIG. 8 illustrates an orifice plate 700 according to still another embodiment of the disclosure. The orifice plate 700 has same or similar structures as the orifice plate 300, except for the structures of the fluid passageways and the orifices. The orifice plate 700 includes a first fluid passageway 712 having a first orifice 722, a second fluid passageway 714 having a second orifice 724, a third fluid passageway 716 having a third orifice 726, and a fourth fluid passageway 718 having a fourth orifice 728. All of the fluid passageways have substantially the same uniform diameter. The four fluid passageways form a single focal point F4. The distance from the focal point F4 to the exterior surface of the orifice plate 700 can be substantially the same as the distance H of the orifice plate 300. According to this embodiment, the first orifice 722 and the second orifice 724 are arranged on an imaginary circle having a diameter D12 and the third orifice 726 and the fourth orifice 728 are arranged on an imaginary circle having a diameter D34 smaller than D12. The first orifice 722 and the second orifice 724 are radially opposite each other and angularly spaced from each other by about 180°. The third orifice 726 and the fourth orifice 728 are radially opposite each other and angularly spaced from each other by about 180°. The first orifice 722 is angularly spaced from the third orifice 726 by about 90°. The second orifice 724 is angularly spaced from the fourth orifice 728 by about 90°. The first fluid passageway 712 and the second fluid passageway 714 forms a first included angle α41. The third fluid passageway 716 and the fourth fluid passageway 718 forms a second included angle α42 smaller than the first included angle α41. The value of both included angles α41 and α42 can be in the same range as that of the included angle α of the orifice plate 300.

Figure 9A:
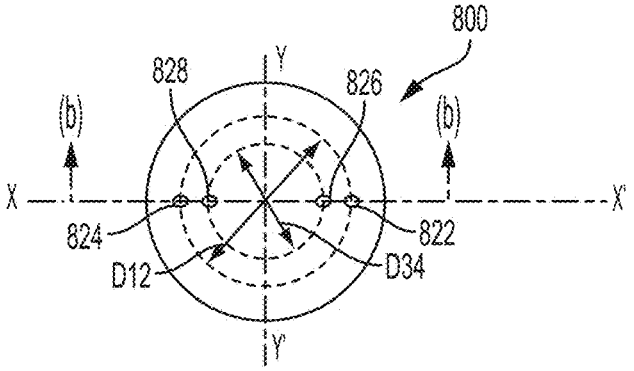
FIG. 9 illustrates an orifice plate according to still another embodiment of the disclosure.
Figure 9B:
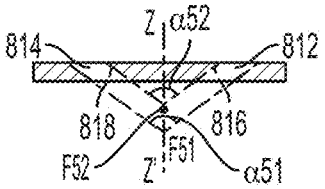

FIG. 9 illustrates an orifice plate 800 according to still another embodiment of the disclosure. The orifice plate 800 has same or similar structures as the orifice plate 300, except for the structures of the fluid passageways and the orifices. The orifice plate 800 includes a first fluid passageway 812 having a first orifice 822, a second fluid passageway 814 having a second orifice 824, a third fluid passageway 816 having a third orifice 826, and a fourth fluid passageway 818 having a fourth orifice 828. All of the fluid passageways have substantially the same uniform diameter. According to this embodiment, the first orifice 822 and the second orifice 824 are arranged on an imaginary circle having a diameter D12 and the third orifice 826 and the fourth orifice 828 are arranged on an imaginary circle having a diameter D34 smaller than D12. The first orifice 822 and the second orifice 824 are radially opposite each other and angularly spaced from each other by about 180°. The third orifice 826 and the fourth orifice 828 are radially opposite each other and angularly spaced from each other by about 180°. The first fluid passageway 812 and the second fluid passageway 814 forms a first focal point F51 and a first included angle α51. The third fluid passageway 816 and the fourth fluid passageway 818 forms a second focal point F52 and a second included angle α52. The value of the first included angle α51 and the second included angle α52 are substantially the same as, and can be in the range of, that of the included angle α of the orifice plate 300. The distance from the first focal point F51 to the exterior surface of the orifice plate 800 is larger than the distance from the first focal point F52 to the exterior surface of the orifice plate 800. The distance of both focal points can be substantially in the same range as the distance H of the orifice plate 300. According to this embodiment, the colliding stream jets can be grouped in two colliding sets.

Figure 10A:
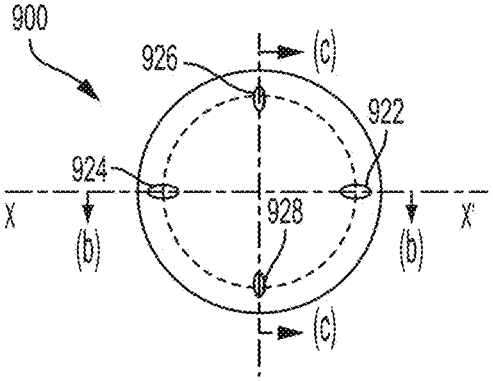
FIG. 10 illustrates an orifice plate according to still another embodiment of the disclosure.
Figure 10B:
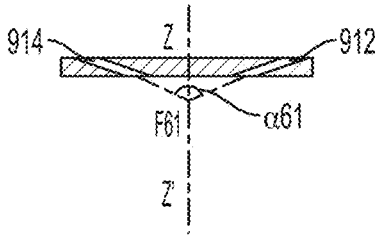
Figure 10C:
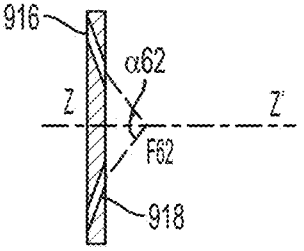

FIG. 10 illustrates an orifice plate 900 according to still another embodiment of the disclosure. The orifice plate 900 has same or similar structures as the orifice plate 300, except for the structures of the fluid passageways and the orifices. The orifice plate 900 includes a first fluid passageway 912 having a first orifice 922, a second fluid passageway 914 having a second orifice 924, a third fluid passageway 916 having a third orifice 926, and a fourth fluid passageway 918 having a fourth orifice 928. All of the fluid passageways have about the same uniform diameter. The four orifices are arranged on an imaginary circle and are substantially equiangularly spaced from each other by about 90°. The first fluid passageway 912 and the second fluid passageway 914 forms a first included angle α61 and a first focal point F61. The third fluid passageway 916 and the fourth fluid passageway 918 forms a second included angle α62 and a second focal point F62. The first included angle α61 is greater than the second included angle α62, while the value of both angles can be in the same range as that of the included angle α of the orifice plate 300. The distance from the first focal point F61 to the exterior surface of the orifice plate 900 is smaller than the distance from the second focal point F62 to the exterior surface of the orifice plate 900. The distances of both focal points to the exterior surface can be in the same range as the distance H of the orifice plate 300, respectively.

Figure 11A:
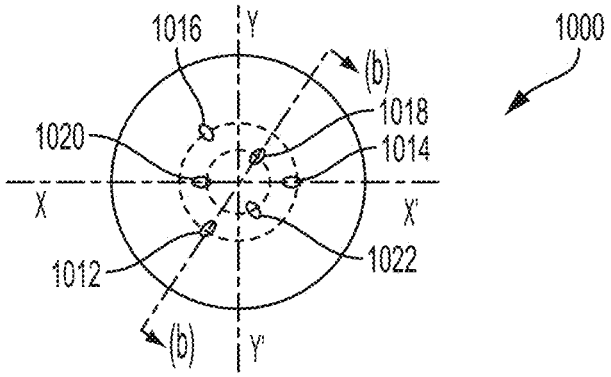
FIG. 11 illustrates an orifice plate according to still another embodiment of the disclosure.
Figure 11B:
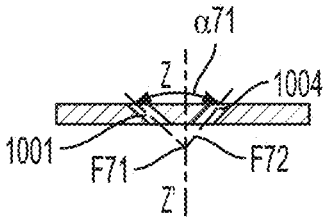
Figure 11C:
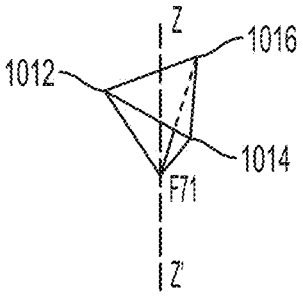

FIG. 11 illustrates an orifice plate 1000 according to still another embodiment of the disclosure. The orifice plate 1000 has same or similar structures as the orifice plate 300, except for the structures of the fluid passageways and the orifices. The orifice plate 1000 includes six fluid passageways 1001-1006 (only the first fluid passageway 1001 and the fourth fluid passageway 1004 are shown in FIG. 11(*b*)) and six orifices 1012, 1014, 1016, 1018, 1020 and 1022 associated with the six fluid passageways, respectively. All of the fluid passageways have substantially the same uniform diameter. The first to third fluid passageways form a first colliding set and the fourth to sixth fluid passageways form a second colliding set. According to this embodiment, the first orifice 1012, the second orifice 1014 and the third orifice 1016 are arranged on a first imaginary circle having a first diameter, the fourth orifice 1018, the fifth orifice 1020 and the sixth orifice 1022 are arranged on a second imaginary circle having a second diameter smaller than the first diameter. The first orifice 1012, the second orifice 1014 and the third orifice 1016 are radially distributed and are substantially equiangularly spaced from each other by about 120°. The fourth orifice 1018, the fifth orifice 1020 and the sixth orifice 1022 are radially distributed and are substantially equiangularly spaced from each other by about 120°. In addition, every two adjacent orifices are substantially equiangularly spaced by about 60°. The first to third fluid passageways form a first focal point F71 and a first included angle α71 (as shown in FIG. 11(*c*)) between every two colliding jets in the same colliding set. The fourth to sixth fluid passageways form a second focal point F72 and a second included angle α72 (not shown) between every two colliding jets in the same colliding set. The first included angle α71 is greater than the second included angle α72, while the value of both angles can independently be in the same range of that of the included angle α of the orifice plate 300. The distance from the first focal point F71 to the exterior surface of the orifice plate 1000 is greater than the distance from the second focal point F72 to the exterior surface of the orifice plate 1000. The distances of both focal points to the exterior surface can be in the same range as the distance H of the orifice plate 300.

Figure 12A:
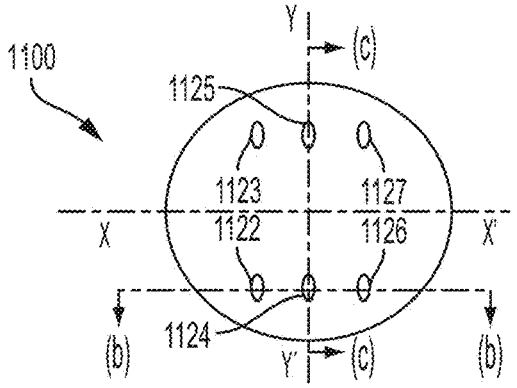
FIG. 12 illustrates an orifice plate according to still another embodiment of the disclosure.
Figure 12B:
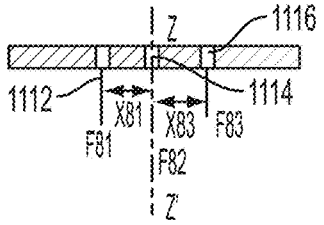
Figure 12C:
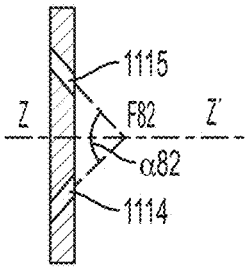

FIG. 12 illustrates an orifice plate 1100 according to still another embodiment of the disclosure. The orifice plate 1100 has same or similar structures as the orifice plate 300, except for the structures of the fluid passageways and the orifices. The orifice plate 1100 includes first to six fluid passageways 1112-1117 (only the first, third and fifth fluid passageways are shown in FIG. 12(*b*)) and six orifices 1122-1127 associated with the six fluid passageways, respectively. All of the fluid passageways have substantially the same uniform diameter. In this embodiment, the first and second fluid passageways 1112 and 1113 form a first pair of colliding jets; the third and fourth fluid passageways 1114 and 1115 form a second pair of colliding jets; and the fifth and sixth fluid passageways 1116 and 1117 form a third pair of colliding jets. The first and second fluid passageways form a first focal point F81 and a first included angle α81 (not shown); the third and fourth fluid passageways form a second focal point F82 and a second included angle α82 (as shown in FIG. 12(*c*)); and the fifth and sixth fluid passageways form a third focal point F83 and a third included angle α83 (not shown). The first included angle α81, the second included angle α82 and the third included angle α83 are about the same, and the values thereof can be in the same range as that of the included angle α of the orifice plate 300. The distance from the first focal point F81 to the exterior surface of the orifice plate 1100, the distance from the second focal point F82 to the exterior surface of the orifice plate 1100 and the distance from the third focal point F83 to the exterior surface of the orifice plate 1100 are about the same, and can be in the same range as the distance H of the orifice plate 300. As shown in FIG. 12(*b*), the first focal point F81 is offset from the axis Z-Z' by a distance of X81; the second focal point F82 is on the axis Z-Z'; and the third focal point F83 is offset from the axis Z-Z' by a distance of X83. In this embodiment, every two orifices for forming a pair of jets are aligned with one another, with respect to the axis X-X' and the axis Y-Y'. As a result, three focal points are provided, which are substantially equally distanced from the exterior surface of the plate but do not necessarily fall on the axis Z-Z'.

Figure 13A:
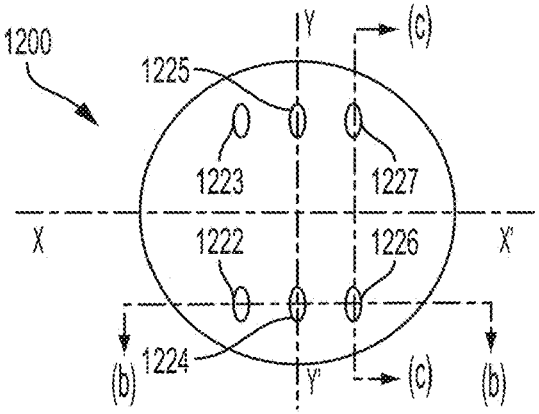
FIG. 13 illustrates an orifice plate according to still another embodiment of the disclosure.
Figure 13B:
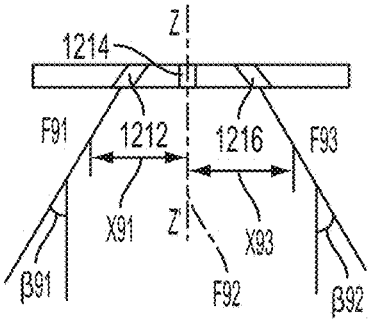
Figure 13C:
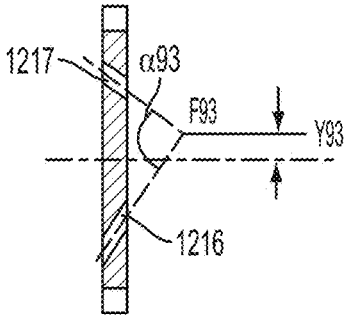
Figure 14A:
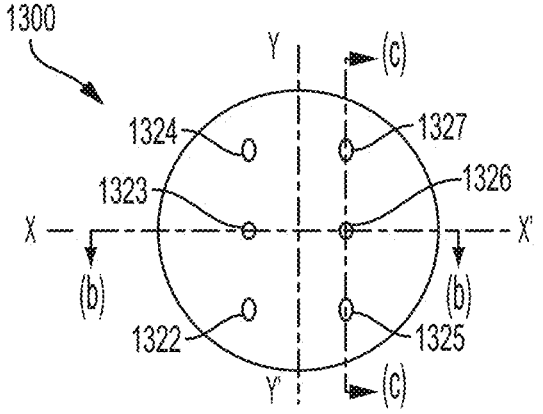
FIG. 14 illustrates an orifice plate according to still another embodiment of the disclosure.
Figure 14B:
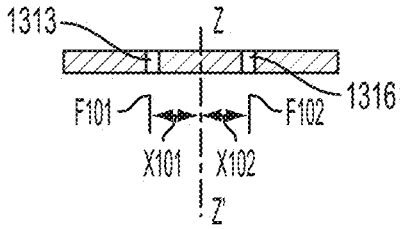
Figure 14C:
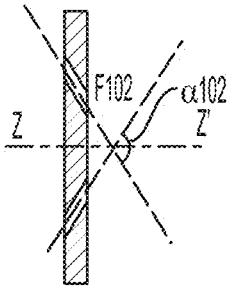

FIG. 13 illustrates an orifice plate 1200 according to still another embodiment of the disclosure. The orifice plate 1200 has same or similar structures as the orifice plate 300, except for the structures of the fluid passageways and the orifices. The orifice plate 1200 includes first to six fluid passageways 1212-1217 (only the first, third and fifth fluid passageways are shown in FIG. 13(*b*)) and six orifices 1222-1227 associated with the six fluid passageways, respectively. All of the fluid passageways have substantially the same uniform diameter. In this embodiment, the first and second fluid passageways 1212 and 1213 form a first pair of colliding jets; the third and fourth fluid passageways 1214 and 1215 form a second pair of colliding jets; and the fifth and sixth fluid passageways 1216 and 1217 form a third pair of colliding jets. The first and second fluid passageways form a first focal point F91 and a first included angle α91 (not shown); the third and fourth fluid passageways form a second focal point F92 and a second included angle α92 (not shown); and the fifth and sixth fluid passageways form a third focal point F93 and a third included angle α93 (as shown in FIG. 13(*c*)). The first included angle α91 and the third included angle α93 are substantially equal; and the second included angle α82 is greater than the first included angle α91 and the third included angle α93. The value of the first to third included angles can be in the same range as that of that of the included angle α of the orifice plate 300. The distance from the first focal point F91 to the exterior surface of the orifice plate 1200, the distance from the second focal point F92 to the exterior surface of the orifice plate 1200 and the distance from the third focal point F93 to the exterior surface of the orifice plate 1200 are substantially equal, and can be in the same range as that of the distance H of the orifice plate 300. The third focal point F93 is offset from the axis Z-Z' by both a distance of X93 (as shown in FIG. 13(*b*)) and a distance of Y93 (as shown in FIG. 13(*c*)). The first focal point F91 is offset from the axis Z-Z' by both a distance X91 (as shown in FIG. 13(*b*)) and a distance Y91 (not shown). The distance X91 and the distance X93 can be substantially the same and are substantially symmetrical with respect to the axis Y-Y'. The distance Y91 and the distance Y93 can be substantially equal and are substantially symmetrical with respect to the axis X-X'; alternatively, the distance Y91 and the distance Y93 can be at the same side of the plane defined by the axis X-X' and the axis Z-Z'. In this latter embodiment, the first pair of colliding jets created by the first and second fluid passageways forms a plane, which has an angle β91 (as shown in FIG. 13(*b*)) with respect to the plane formed by the second pair of colliding jets created by the third and fourth fluid passageways; the third pair of colliding jets created by the fifth and sixth fluid passageways also forms a plane, which has an angle β92 (as shown in FIG. 13(*b*)) with respect to the plane formed by the second pair of colliding jets. As shown in FIG. 13(*b*); with respect to the axis Z-Z FIG. 14 illustrates an orifice plate 1300 according to still another embodiment of the disclosure. The orifice plate 1300 has same or similar structures as the orifice plate 300, except for the structures of the fluid passageways and the orifices. The orifice plate 1300 includes first to six fluid passageways 1312-1317 (only the second and the fifth fluid passageways are shown in FIG. 14(*b*)) and six orifices 1322-1327 associated with the six fluid passageways, respectively. All of the fluid passageways have substantially the same uniform diameter. In this embodiment, the first to third fluid passageways 1312-1314 form a first set of three colliding jets; the fourth to sixth fluid passageways 1315-1317 form a second set of three colliding jets. The first to third fluid passageways 1312-1314 form a first focal point F101 and a first included angle α101 (not shown); the fourth to sixth fluid passageways 1315-1317 form a second focal point F102 and a second included angle α10 (shown in FIG. 14(*c*)). The first included angle α101 and the second included angle α102 are substantially equal and the value thereof can be in the same range as that of the included angle α of the orifice plate 300. The distance from the first focal point F101 to the exterior surface of the orifice plate 1300 and the distance from the second focal point F102 to the exterior surface of the orifice plate 1300 are substantially the same, and can be in the same range as that of the distance H of the orifice plate 300. In this embodiment, both the first included angle α101 and the second included angle α102 are bisected by the stream jet created by the middle fluid passageway of each set of passageways.

Figure 15A:
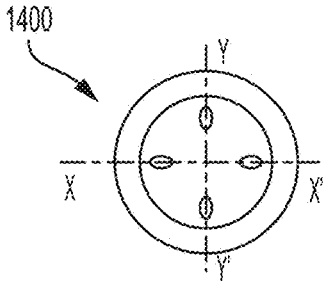
FIG. 15 illustrates an orifice plate according to still another embodiment of the disclosure.
Figure 15B:
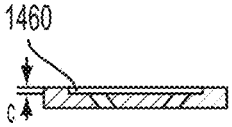

FIG. 15 illustrates an orifice plate 1400 according to still another embodiment of the disclosure. The orifice plate 1400 has same or similar structures as the orifice plate 300, except that a cavity 1460 for diverging pressurized fluid is formed in the interior end of the orifice plate 1400, rather than formed into a nozzle body used with the orifice plate. For example, the cavity 1460 can have a depth and a diameter, which are the same as those of the cavity 260.

Figure 16A:
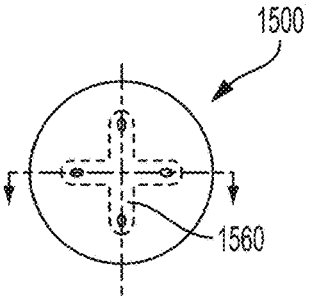
FIG. 16 illustrates an orifice plate according to still another embodiment of the disclosure.
Figure 16B:
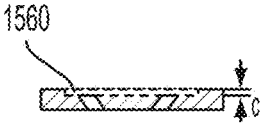

FIG. 16 illustrates an orifice plate 1500 according to still another embodiment of the disclosure. The orifice plate 1500 has same or similar structures as the orifice plate 1400, except that a plurality of channels 1560 for diverging pressurized fluid is formed in the interior end of the orifice plate 1500. The channels 1560 are in fluid communication with each other and with the fluid passageways of the orifice plate. The channels 1560 can have approximately the same depth as the depth of the cavity 1460. For example, each channel can originate from the center of the orifice plate and move outward to the entrance of a respective fluid passageway.

Figure 17A:
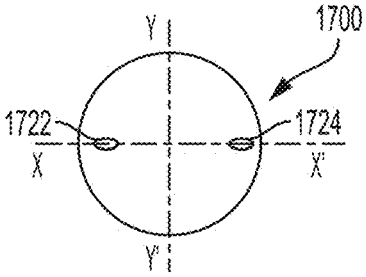
FIG. 17 illustrates an orifice plate according to still another embodiment of the disclosure.
Figure 17B:
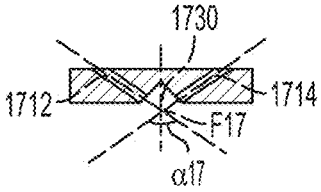

FIG. 17 illustrates an orifice plate 1700 according to still another embodiment of the disclosure. In this embodiment, the orifice plate 1700 defines a cone-shaped cavity 1730 at the exterior end of the orifice plate. The orifice plate 1700 includes two fluid passageways 1712 and 1714, which together form a focal point F17 and an included angle α17. The value of the included angle α17 can be substantially in the same range as that of the included angle α of the orifice plate 300. The cone-shaped cavity 1730 provides a space for the liquid jets to sufficiently impinge on each other through the fluid passageways 1712 and 1714. The conical face of the cavity 1730 can be substantially perpendicular to the fluid passageways 1712 and 1714.

Figure 18:
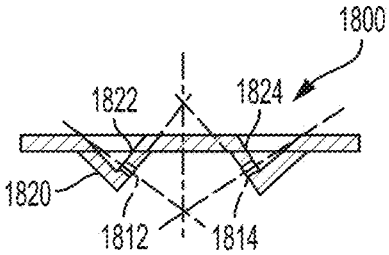
FIG. 18 illustrates an orifice plate according to still another embodiment of the disclosure.

FIG. 18 illustrates an orifice plate 1800 according to still another embodiment of the disclosure. In this embodiment, the orifice plate 1800 is a formed plate, which has an annular ring 1820 protruding toward the exterior end of the orifice plate. The annular ring 1820 defines two internal surfaces 1822 and 1824. The orifice plate 1800 further includes two fluid passageways 1812 and 1814. The axis of the fluid passageway 1812 is substantially perpendicularly to the internal surface 1822 and the axis of the fluid passageway 1814 is substantially perpendicular to the internal surface 1824.

Figure 19:
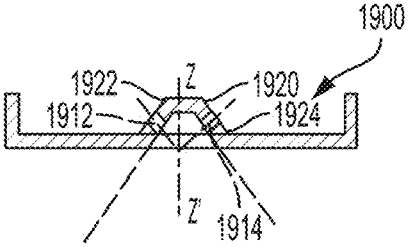
FIG. 19 illustrates an orifice plate according to still another embodiment of the disclosure.

FIG. 19 illustrates an orifice plate 1900 according to still another embodiment of the disclosure. In this embodiment, the orifice plate 1900 is a formed plate, which has a formed central dimple 1920 protruding toward the interior end of the orifice plate. The orifice plate 1900 further includes two fluid passageways 1912 and 1914, which pass through the central dimple 1920. The dimple 1920 includes two walls 1922 and 1924, which are formed angularly with respect to the axis Z-Z'. The fluid passageways 1912 and 1914 are formed through the walls 1922 and 1924, respectively, and can be substantially perpendicularly to each respective wall.

Figure 20:
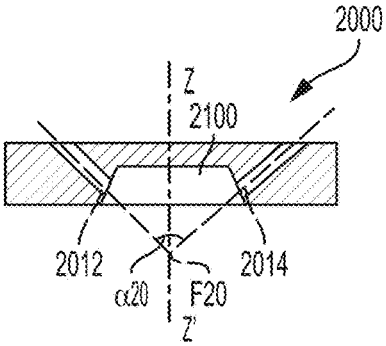
FIG. 20 illustrates an orifice plate according to still another embodiment of the disclosure.

FIG. 20 illustrates an orifice plate 2000 according to still another embodiment of the disclosure. In this embodiment, the orifice plate 2000 defines a frustoconical shaped 2100 at the exterior end of the orifice plate. The orifice plate 2000 includes two fluid passageways 2012 and 2014, which together form a focal point F20 and an included angle α20. The conical face of the cavity 2100 can be substantially perpendicular to the fluid passageways 2012 and 2014.

Figure 21:
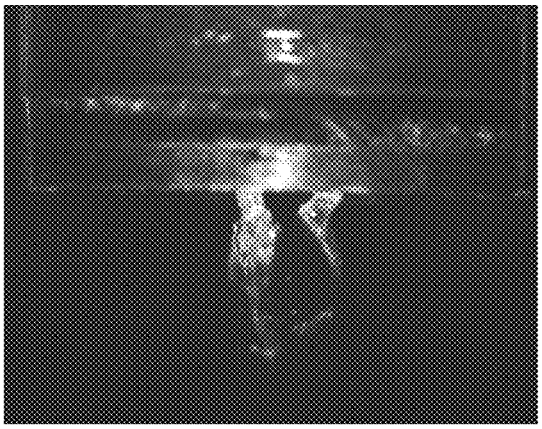
FIGS. 21-23 are speed imaging of colliding jets created by an injector nozzle according to an exemplary embodiment of the disclosure.
Figure 22:
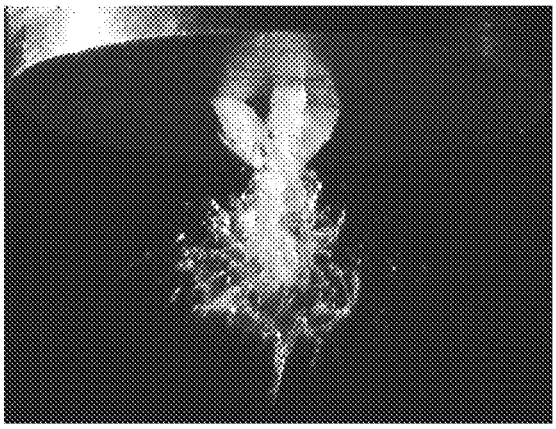
Figure 23:
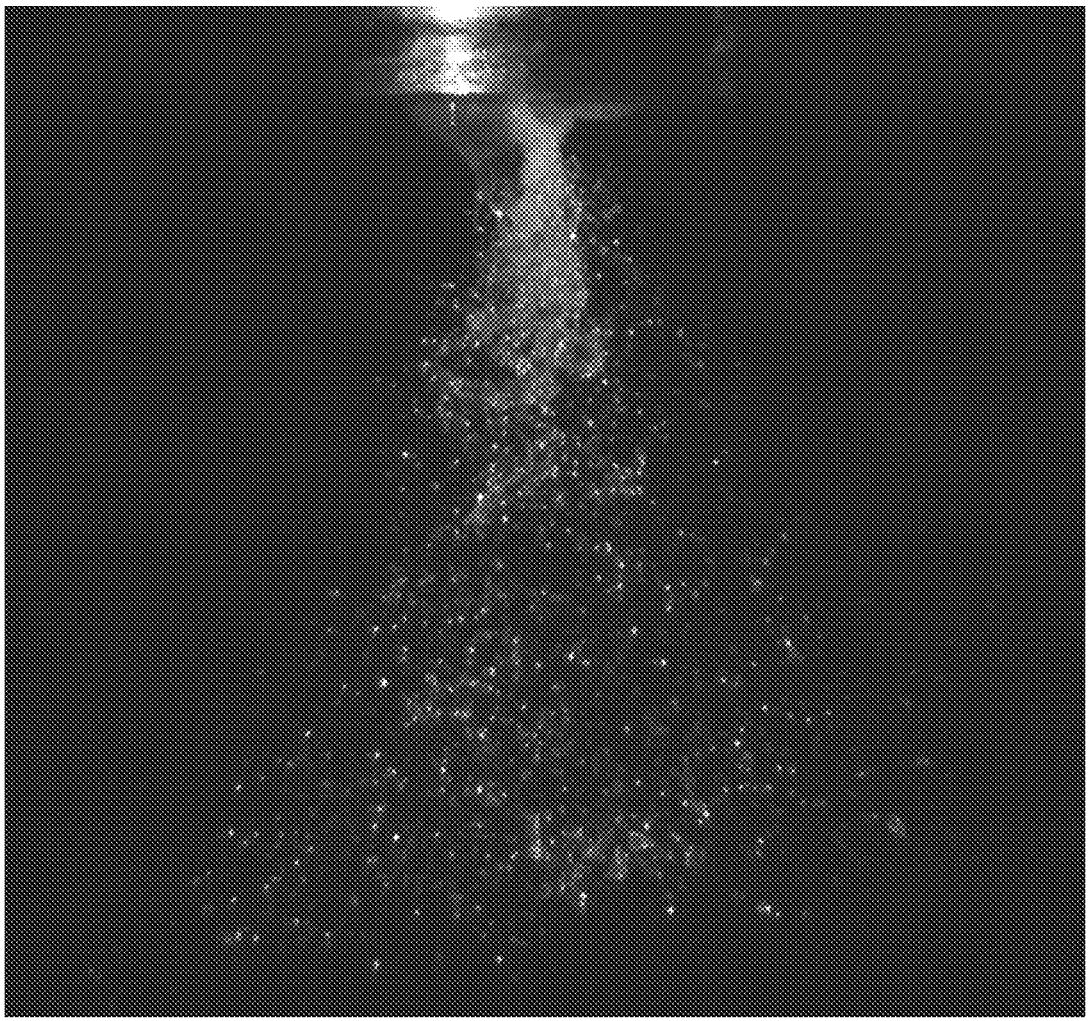

FIGS. 21-23 are images showing the colliding jets created by an embodiment of the disclosure, in which three orifice passages are provided to create a colliding set having a single focal point. FIG. 21 shows a speed imaging of the colliding set exiting the orifice plate exterior face. FIG. 22 shows a speed imaging of the fluid jets colliding substantially at a specific focal point, which is distanced from the orifice plate exterior face in order to avoid back-spray or coalescence on the exterior face of the orifice plate. FIG. 23 shows a speed imaging of the fluid jets dispersing to form a spray plume.

Figure 24:
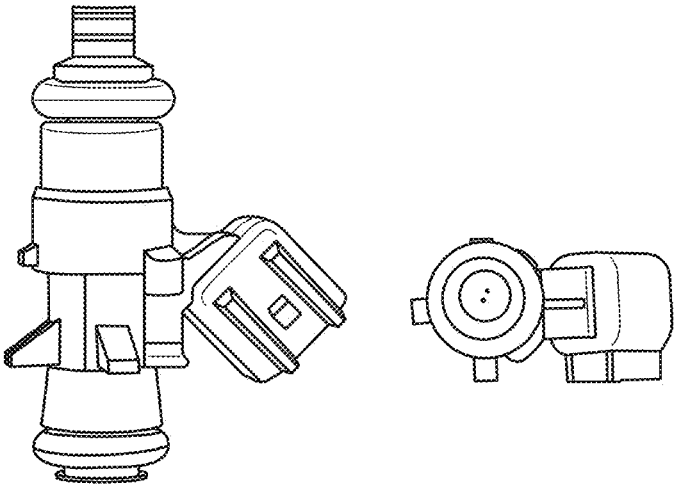
FIG. 24 illustrates an injector, which incorporates a nozzle having an orifice plate according to an exemplary embodiment of the disclosure.

FIG. 24 illustrates an injector, which incorporates a nozzle having an orifice plate according to an embodiment of the disclosure. The orifice plate has two fluid passageways. The injector is capable of metering and controlling the flow of the fluid into an internal combustion engine.

Figure 25:
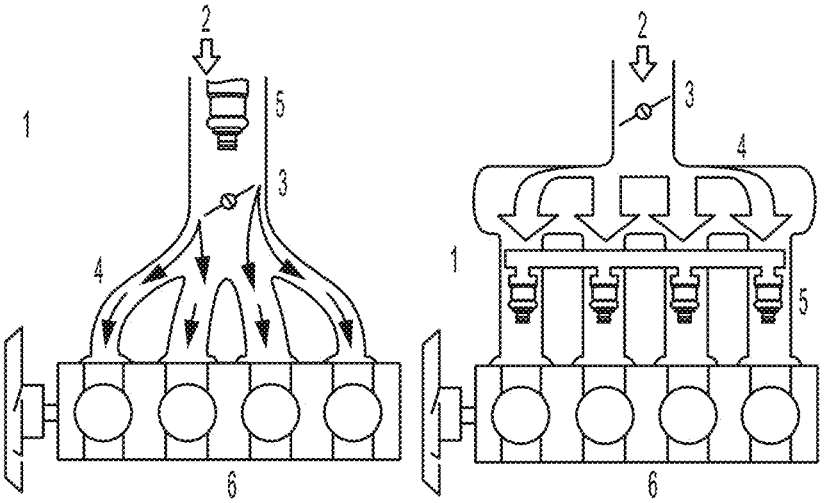
FIG. 25 schematically depicts the utilization of an injector to inject a fuel into an internal combustion engine.

FIG. 25 schematically depicts the utilization of an injector 1 of FIG. 24 to inject a fuel into an internal combustion engine 6. The injector is located in the intake track of the internal combustion engine. As shown in FIG. 25(*a*), the injector 1, incorporating an orifice plate according to an exemplary embodiment of the disclosure, is positioned in the air intake tack 5, prior to the air throttling mechanism 3 or downstream of the air throttling mechanism, although not shown. The intake air 2 flows through the intake track 5 and a fuel is injected into the air stream. Subsequently, the fuel passes through four intake runners 4 into the cylinders of the internal combustion engine 6, which is a four-cylinder internal combustion engine. Alternatively, as shown in FIG. 25(*b*), multiple injectors 1 (four in this embodiment) can be placed anywhere in each intake runner 5 for each individual cylinder of the internal combustion engine 6. The intake air 2 flows into the intake track, past the air throttling mechanism 3 and into intake manifold 4. The intake air 2 subsequently flows into each individual intake runner 5, where a fuel is injected through the injectors 1 into the intake runners 5 of the internal combustion engine 6.

Figure 26A:
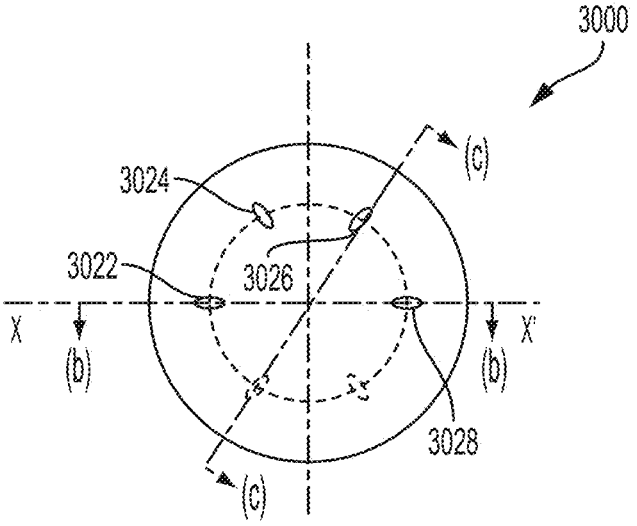
FIG. 26 illustrates an orifice plate according to yet another embodiment of the disclosure.
Figure 26B:
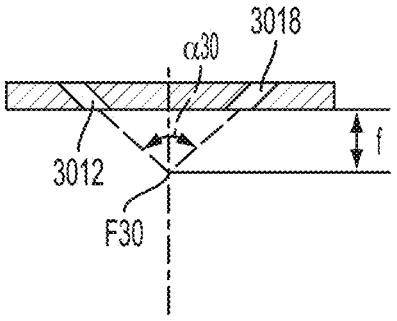
Figure 26C:
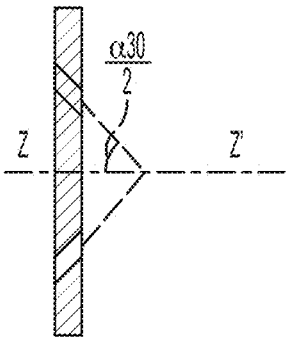
Figure 27A:
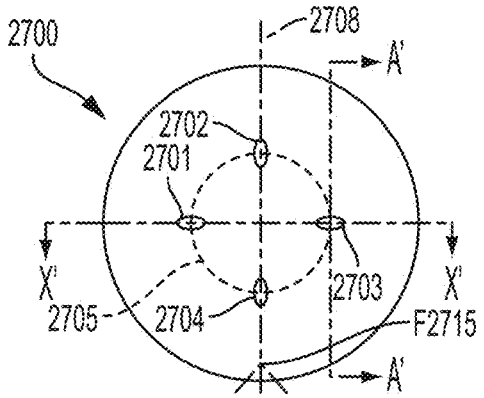
FIG. 27 illustrates an orifice plate according still to yet another embodiment of the disclosure.
Figure 27B:
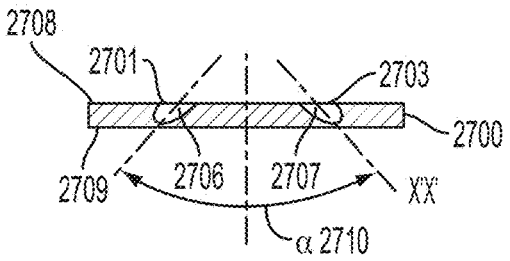
Figure 27C:
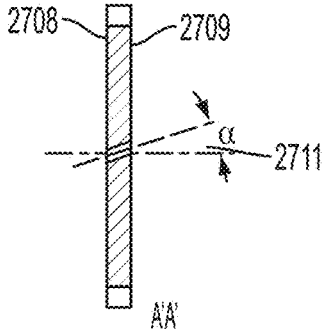
Figure 27D:
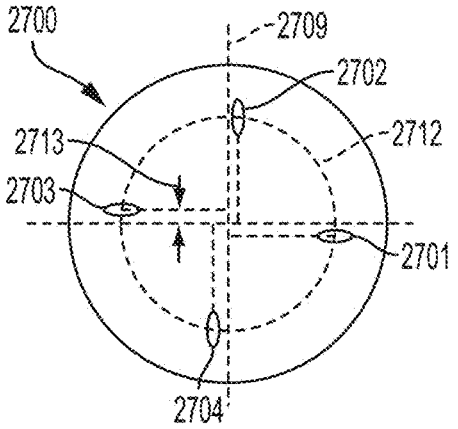

FIG. 26 illustrates an orifice plate 3000 according to still another embodiment of the disclosure. The orifice plate 3000 has same or similar structures as the orifice plate 300, except for the structures of the fluid passageways and the orifices. The orifice plate 3000 includes first to fourth fluid passageways 3012-3018, each having an associated orifice 3022-3028. For example, all of the fluid passageways have substantially the same uniform diameter. The four orifices are arranged on an imaginary circle but distributed radially asymmetrically with respect to the axis Z-Z'. The four fluid passageways are oriented at substantially the same included angle α30 and are targeted at focal point F30 that is distanced from the exterior end of the orifice plate. The radial positioning of each fluid passageway is oriented about 60 degrees from the other, which orientation corresponds to the orientation of an evenly radially distributed six fluid passageways hole colliding set. As shown in the figure, two adjacent holes of a six-hole colliding set are omitted from this four hole colliding set, with the four remaining holes establishing the asymmetrical colliding set, which results in a biased spray plume due to the unbalanced lateral liquid momentum. In this embodiment, three or more fluid passageways through the orifice plate are oriented in a colliding set, along a single imaginary circle, with a single focal point distance f from the exterior end of the orifice plate. The fluid passageways form a single included angle, individually equal to or greater than ninety degrees. The radial position of the passages along the imaginary circle is asymmetrical, where the passages are oriented in a formation of a greater number of passages evenly distributed, or not, radially. One or more of the fluid passageways is omitted, thereby forming an asymmetrical distribution of passages along the circle. This embodiment, in addition to improved atomization of the fluid and short liquid length, also provides a directionally biased spray plume, defined by the unbalanced momentum of the asymmetrical colliding jet orientation.

FIG. 27 illustrates an orifice plate 2700 according to another embodiment of the disclosure. The orifice plate 2700 has same or similar structure as the orifice plate 300, except for the structure of the fluid passageways and orifices. The orifice plate 2700 has a first fluid passageway 2701, a second fluid passageway 2702, a third fluid passage way 2703 and a fourth fluid passageway 2704, each with corresponding orifices. The orifice plate 2700 has a front fluid exit side 2708 and a back fluid entrance side 2709. The centers of fluid passages 2701, 2702, 2703, and 2704 are aligned radially along imaginary circle 2705 at the fluid exit side 2708. The centers of fluid passages 2701, 2702, 2703, and 2704 are aligned radially along imaginary circle 2712 at the fluid entrance side 2709. As shown in FIG. 27(*c*) that is a sectional view along lines A'-A' of FIG. 27(*a*), the fluid passage 2703 passes through the plate 2700 at an angle α2711, at which each of the fluid passages 2701, 2702, 2703 and 2704 are oriented through the plate. As shown in FIG. 27(*b*) that is a sectional view along lines X'-X' of FIG. 27(*a*), the fluid passageways 2701 and 2703 form an included angle α2710 and focal point F2715, at which point fluid jets exiting the passageways 2701 and 2703 substantially impinge on the other. As shown in FIG. 27(*b*), the orifice section 2706 formed by passage 2701 and orifice section 2707 formed by passage 2703 are partially exposed due to the angle α2711. FIG. 27(*d*) is a back view of the orifice plate 2700, which is reverse of FIG. 27(*a*), the angle α 2711 results in the fluid passages 2701, 2702, 2703 and 2704 to exit on the back side 2709 of the plate 2700 at an offset distance 2713 from the axial position of each orifice 2701, 2702, 2703, 2704, at the front side 2708 of the plate 2700. The compound angle geometry of fluid passageways 2701, 2702, 2703 and 2704 result in a substantial impingement of the fluid jets at focal point F2715 and a resulting spiraling effect of the resulting spray plume. The compound geometry of the embodiment in FIG. 27 is effective in creating resultant spray plumes of the atomized liquid, downstream of the impingement focal point F. In addition, less than 100%, but greater than 60% of the cross section of the fluid orifice jets impinge on another, and generate an atomized form of the fluid with a spiraling motion and wide resultant spray plume angle.

The orifice plate may be useful for a variety of fluids, such as liquid fuels, oxidizers, fuel-alcohol blends including Ethanol blends ranging from E0 to E100, water, salt, urea, adhesive, finish coatings, paint, lubricants or any solutions or mixtures therein. For example, the fluid can be a volatile fuel of any gasoline-alcohol blends including E0, E1, E2, E3, E4, E5, E6, E7, E8, E9, E10, E15, E20, E25, E30, E40, E50, E60, E70, E75, E85, E90, E95, E97, E98, E99, E100. The fluid can be water and alcohol and any mixture therein.

The fluid can be water and salt, and any mixture therein. The fluid can be water and urea, and any mixture thereof.

Accordingly, the orifice plate may be constructed of any material typically used. For example, it may be constituted of any grade of steel, aluminum, brass, copper, alloys therein, composites including graphite, ceramic, carbon or fiber blends, or a multitude of plastic chemistries.

In the embodiments above, where there are more than one focal point present and each is associated with a different included angle, e.g., wherein a first group of orifices provide a first focal point associated with a first included angle and where there is a second group of orifices provide a second focal point associated with a second included angle, the vertical distance from the respective focal points to the exterior surface of the orifice plate, such as in the above example, the first vertical distance from the first focal point to the exterior surface of the orifice plate and the second vertical distance from the first focal point to the exterior surface of the orifice plate, independently range from about 0.25 mm to about 28.0 mm, while in another embodiment, they can independently range from 0.25 mm to about 24 mm, and in still another embodiment, they can independently range from about 0.25 mm to about 20 nm, while in another embodiment, they can independently range from about 0.25 to about 4 mm. For example, the distances can independently be 0.25 mm, 0.5 mm, 0.6 mm, 0.7 mm, 0.8 mm, 0.9 mm, 1.0 mm, 1.5 mm, 2.0 mm, 2.5 mm, 3.0 mm, 3.5 mm, 4.0 mm, 4.5 mm, 5.0 mm, 5.5 mm, 6.0 mm, 7.0 mm, 8.0 mm, 9.0 mm, 10.0 mm, 11.0 mm, 12.0 mm, 13.0 mm, 14.0 mm, 15.0 mm, 16.0 mm, 17.0 mm, 18.0 mm, 19.0 mm, 20.0 mm, 21.0 mm, 22.0 mm, 23.0 mm, 24.0 mm, 25.0 mm, 26.0 mm, 27.0 mm or 28.0 mm or any number therebetween.

While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. It is the intention, therefore, to be limited only as indicated by the scope of the claims appended hereto.

What is claimed is:

1. An injector nozzle used with an internal combustion engine for guiding and shaping a fluid flow, comprising:

a nozzle body comprising an inlet for admitting the fluid flow and an outlet;

an orifice plate provided at the outlet of the nozzle body, wherein the nozzle body and the orifice plate are both configured to extend symmetrically with respect to a central axis, wherein the orifice plate has an interior surface facing the nozzle body and an opposite exterior surface, the interior surface and the exterior surface being substantially planar and parallel to each other to define a thickness of the orifice plate; and a cavity defined between the orifice plate and the nozzle body, wherein the fluid flow converges at the cavity, wherein the orifice plate comprises a plurality of fluid passageways, each fluid passageway having an orifice on the exterior surface, said fluid passageways extending from the interior surface to the exterior surface and being in fluid communication with the cavity, wherein the fluid flow diverges through the fluid passageways to create a plurality of stream jets, and wherein at least one focal point and at least one included angle associated with the focal point are created where the imaginary extensions of the plurality of fluid passageways converge, and wherein the fluid passageways are angled such that they extend toward the central axis in the direction from the interior surface to the orifice on the exterior surface of the orifice plate;

wherein the plurality of fluid passageways forms a first focal point and a second focal point, and at least one of the first focal point and the second focal point is offset with respect to the central axis and at least two stream jets from the plurality of stream jets converge at the first focal point to atomize the fluid and at least two stream jets from the plurality of stream jets converge at the second focal point to atomize the fluid.

2. The injector nozzle according to claim 1, wherein the fluid flow is pressurized and the pressure applied to the fluid flow is in a range from about 5 psi to about 500 psi.

3. The injector nozzle according to claim 1, wherein the included angle is in a range from about 91° to about 99°.

4. The injector nozzle according to claim 1, wherein the included angle is in a range from about 91° to about 160°.

5. The injector nozzle according to claim 1, wherein the cavity has a height defined as a vertical distance from an internal surface of the nozzle body to the interior surface of the orifice plate, wherein the height is in a range from about 5 μm to about 100 μm.

6. The injector nozzle according to claim 1, wherein the cavity has a height defined as a vertical distance from an internal surface of the nozzle body to the interior surface of the orifice plate, wherein the height is in a range from about 100 μm to about 500 μm.

7. The injector nozzle according to claim 1, wherein the plurality of orifices of the fluid passageways are arranged on a single imaginary circle on the exterior surface of the orifice plate.

8. The injector nozzle according to claim 7, wherein the plurality of orifices are equiangularly distanced from each other.

9. The injector nozzle according to claim 7, wherein the plurality of orifices are asymmetrically distributed on the imaginary circle with respect to the central axis.

10. The injector nozzle according to claim 9, wherein the plurality of orifices comprises a first orifice, a second orifice angularly spaced from the first orifice by about 60°, a third orifice angularly spaced from the second orifice by about 60° and a fourth orifice angularly spaced from the third orifice by about 60°.

11. The injector nozzle according to claim 1, wherein the first focal point has a first vertical distance from the exterior surface and the second focal point as a second vertical distance from the exterior surface and the first vertical distance and the second vertical distance are substantially equal.

12. The injector nozzle according to claim 1, wherein the plurality of orifices of the fluid passageways are divided into a first group arranged on a first imaginary circle and a second group arranged on a second imaginary circle, wherein the first imaginary circle and the second imaginary circle have different diameters, wherein the first group of orifices provide the first focal point having a first vertical distance from the exterior surface of the orifice plate, and the second group of orifices provide the second focal point having a second vertical distance from the exterior surface of the orifice plate.

13. The injector nozzle according to claim 12, wherein the first vertical distance and the second vertical distance are substantially equal.

14. The injector nozzle according to claim 12, wherein the first vertical distance and the second vertical distance are non-equal.

15. The injector nozzle according to claim 12, wherein both the first vertical distance and the second vertical distance are in a range from about 0.25 mm to about 24.0 mm.

16. The injector nozzle according to claim 12, wherein both the first vertical distance and the second vertical distance are in a range from about 0.25 mm to about 20.0 mm.

17. The injector nozzle according to claim 12, wherein both the first vertical distance and the second vertical distance are in a range from about 0.25 mm to about 4.0 mm.

18. The injector nozzle according to claim 1, wherein the nozzle body has a recessed internal surface that is substantially planar and parallel to the interior surface of the orifice plate, and the cavity is defined by the recessed internal surface and the interior surface of the orifice plate.

19. The injector nozzle according to claim 1, wherein the orifice plate has a surface that is recessed from and parallel with the interior surface of the orifice plate, and the cavity is defined between the recessed surface and the interior surface of the orifice plate.

* * * * *